US006592451B2

(12) United States Patent
Tang

(10) Patent No.: US 6,592,451 B2
(45) **Date of Patent: *Jul. 15, 2003**

(54) FAN UNIT

(75) Inventor: Lee Zong Tang, Singapore (SG)

(73) Assignee: Kyodo-Allied Industries Ltd, Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 10/191,928

(22) Filed: Jul. 9, 2002

(65) Prior Publication Data

US 2002/0183000 A1 Dec. 5, 2002

Related U.S. Application Data

(63) Continuation of application No. 09/793,855, filed on Feb. 26, 2001, now Pat. No. 6,444,004.

(51) Int. Cl.[7] ..... B01D 19/00

(52) U.S. Cl. ..... 454/473; 415/208.3; 415/211.2; 454/187

(58) Field of Search ..... 55/385.2, 473; 454/187; 415/119, 208.3, 211.2

(56) References Cited

U.S. PATENT DOCUMENTS

| | | | |
|---|---|---|---|
| 4,560,395 | A | 12/1985 | Davis |
| 4,768,424 | A | 9/1988 | Frenkler et al. |
| 5,470,363 | A | 11/1995 | Leader et al. |
| 5,803,721 | A | 9/1998 | Lee |
| 6,019,808 | A | 2/2000 | Ishikawa et al. |
| 6,030,186 | A | 2/2000 | Tang |
| 6,174,342 | B1 | 1/2001 | Jeanseau |

FOREIGN PATENT DOCUMENTS

| | | | |
|---|---|---|---|
| GB | 844129 | A | 8/1960 |
| GB | 942535 | A | 11/1963 |
| GB | 2213926 | A | 8/1989 |
| GB | 2354802 | A | 4/2001 |

*Primary Examiner*—Harold Joyce
(74) *Attorney, Agent, or Firm*—Akerman Senterfitt

(57) ABSTRACT

A fan unit including a fan blower configured to emit air in a plurality of directions in an airflow plane. The fan unit includes first and second guide surfaces disposed on a first side of the fan blower in the airflow plane to define together with a wall part, a first airflow path leading to a first airflow channel. Third and fourth guide surfaces are disposed on a second, opposite, side of the fan blower in the airflow plane, to define with a wall means a second airflow path leading to a second airflow channel. The guide surfaces may be mounted on separate guide means which are identical to one another.

18 Claims, 5 Drawing Sheets

FAN UNIT

The present application is a continuation of U.S. patent application Ser. No. 09/793,855, filed Feb. 26, 2001 U.S. Pat. No. 6,444,004.

The present invention relates to a fan unit. It is common to control the number of particles in the air in a modern production and/or testing facility in order to ensure the quality of its output. Whether it be for wafer dies, compact discs or memory disc drives, effective fan filter units are needed to not only keep the particle contents within the clean room at acceptable levels but also to circulate the air to maintain a pleasant working environment for the clean room workers.

However, such powerful fan filter units create excessive noise. It is known to use insulation materials to line along a conduit, in contact with the air flow, to or within the fan filter units to reduce noise. However, over time, the particles or fibre from the insulation material are dislodged from the surface and contaminate the clean room facility.

The problem associated with fan filter noise is particularly exacerbated in confined spaces or enclosures such as a multi-storey wafer fabrication plant. By confined space, the present invention envisages the height of the ceiling to be less than three meters. Low ceilings cause noise from fan filter units to be particularly pronounced.

Previously, an apparatus which minimises noise from a fan filter unit has been suggested by the current applicant in WO 99/11984.

Another apparatus for minimising noise from a fan filter unit is suggested in British patent application 9923163.1 in the name of the current applicant. In this disclosure, a fan unit is provided which can be used regardless of whether the fan rotates in anti-clockwise or clockwise direction by using a pair of guides disposed on opposite sides of the fan blower in an airflow plane to guide the flow of air between the two guides, each guide having an indent opposite the fan to accommodate the fan and each guide being symmetric about a symmetry plane perpendicular to the air flow plane formed through the centre of the fan and an indent. In a preferred embodiment, the guides have a substantially W-type shape. The S-shaped or W-shaped guides are relatively bulky and complex to manufacture and install. The present inventors have sought to provide a fan unit for reducing noise without increasing contamination in the airflow through the unit, which fan unit is easy to manufacture and has high power efficiency.

The present invention accordingly provides a fan unit comprising:

- a fan blower configured to emit air in a plurality of directions in an airflow plane;
- first and second guide surfaces disposed on a first side of the fan blower in the airflow plane, the first and second guide surfaces defining together, at least partially, the radially outer boundary of a first airflow path leading to a first airflow channel,
- third and fourth guide surfaces disposed on a second, opposite, side of the fan blower in the air flow plane, the third and fourth guide surfaces defining together, at least partially, the radially outer boundary of a second of airflow path leading to a second airflow channel, the first, second, third and fourth guide surfaces being mounted on separate guide means.

By constructing the guides for each airflow path from a pair of separate guide surfaces, construction of the fan unit becomes very simple. A wide variety of configurations can be constructive from a relatively small number of parts.

Each guide surface may be made of any suitable shape. It may be curved or straight. The first and second airflow paths are defined on the radially outer side by the guide surfaces and on the radially inner side by the periphery of the fan blower. The airflow paths may be of any suitable configuration. They may be straight, but preferably, the airflow paths are curved. Preferably, the airflow paths diverge in the angular direction of rotation of the fan blower.

The first or second airflow path may be defined on its radially outer side solely by the respective pair of guides Alternatively, there may be additional guides which define a further part of the airflow path.

In a particularly preferred embodiment, the fan unit comprises a first wall means on the first side of the fan blower, the first guide surface touching the first wall means at a first point and the second guide surface touching the first wall means at a second point displaced from the first point, so that the portion of first wall means between the first and second points effectively defines a further guide surface Similarly, there is preferably a second wall means on the second side of the fan blower, the third guide surface touching the second wall means at a first point and the fourth guide surface touching the second wall means at a second point displaced from the first point so that the portion of the second wall means between the first and second points effectively defines a further guide surface.

There are provided at least four guide means, the first guide means including the first guide surface, the second guide means including the second guide surface, the third guide means including the third guide surface and the fourth guide means including the fourth guide surface.

Preferably, each respective guide means comprises an additional guide surface, facing in a different direction to the respective one of the first, second, third and fourth guide surfaces. The additional guide surfaces of the guide means help to provide a streamline flow path at the point where the air flow path enters the air flow channel.

In a particularly preferred embodiment, at least the first and third guide means are identical to one another and preferably all of the guide means are identical to each other. This particularly simplifies manufacture and construction as only one type of guide means needs to be manufactured.

The guide surfaces and, where present, additional guide surfaces of each guide means are of any suitable configuration, being preferably straight or curved. The transition from a guide surface to the additional guide surface may be defined by a point However, it is preferably defined by a smoothly curving transitional surface, to improve airflow and noise reduction.

Preferably, the first guide surface is closer to the axis of the fan blower than the second guide surface. Similarly, the third guide surface is preferably closer to the axis of the fan blower than the fourth guide surface. In this way, diverging flow paths can be provided. Preferably, the first and third guide surfaces are located at the same distance from the axis of the fan blower and the fourth and second guide surfaces are located at the same distance from the axis of the fan blower as one another. In this way, a rotationally symmetrical arrangement is obtained.

In this arrangement, the fan blower must rotate in the correct direction in order to work In particular, the fan blower must rotate in the direction of increasing air flow path width.

Preferably, the guide means are identical and each guide means is symmetrical about a mirror plane passing through the transition so that it has a guide surface and an additional surface, the additional surface is substantially being identical to the guide surface. The guide means can then be repositioned relatively easily so that the arrangement of the guide surfaces is appropriate to the fan rotating in the opposite direction. In particular, the arrangement of the guide surfaces should be a mirror image of the arrangement of the guide surfaces with the fan rotating in the first direction, with the mirror plane passing through the axis of the fan blower.

Preferably, the first and second airflow channels each lead to a first baffle arranged at an angle to the direction of the airflow to deflect the airflow. Preferably, the airflow is directed in a downward direction.

The vertical direction is taken to be the direction perpendicular to the plane of air emitted from the fan.

Preferably, the first and second airflow channels each comprise a second baffle arranged at an angle to the direction of the flow coming from the first baffle to further deflect the flow. Suitably, the second baffle is mounted below the first baffle. Together, the first and second baffles deflect the respective airflow through an angle in the range 90°–180°, with a minimum of turbulence.

The first and second baffles are preferably inclined with respect to one another, such that the distance between the baffles decreases in a linear direction away from the fan. The baffles are located such that, as the air leaves the guides, the air is deflected by the first baffle onto the second baffle, the second baffle being positioned to direct the air out of an outlet.

Preferably the first baffle or the second baffle and most preferably both of them comprise perforated material to improve sound absorption.

Preferably, the first baffle is arranged at an angle of from 40° to 60°, preferably 45° to the plane of the airflow Preferably, the second baffle is disposed at an angle of 5° to 15°, preferably 10° to the plane of the airflow from the fan.

Preferably, the first and second airflow channels each comprise a final baffle for deflecting the airflow. Preferably, the final baffle deflects the airflow in a downward direction Preferably, the final baffle is mounted beneath the fan blower. Preferably, the final baffles for the first and second airflow channels abut one another to form a generally V shaped structure.

Preferably, the fan unit comprises a housing.

Preferably, the fan blowers and the guide surfaces are disposed on a base plate.

Preferably, the unit further comprises a top housing coupled to the base plate with an inlet for drawing air into the fan, the fan and guides being located between the upper housing and the base plate. Preferably, the housing comprises side sections, an air outlet communicating with a respective airflow channel being formed by a gap between the base, side sections and top housing. Preferably, the side sections comprise wall means as described above. The side sections may be integral with the top housing.

Preferably, the further baffles are at least partly located in the gap between the side sections and the base plate.

In the above configuration, the base plate will preferably be located relative to the housing such that the separation between the base plate and the upper surface of the upper housing is smaller than the distance by which the side sections protrude from the upper surface of the housing. There is also a gap between the side sections and the base plate to form the outlet of the fan unit. The gap between the side sections of the housing and the base plate should, ideally be large enough to accommodate at least a part of the lower baffle in this gap.

Preferably, the fan unit comprises a filter.

The configuration of the guides reduces the noise from the fan unit. Also, the configuration of the guides enhances the velocity of air circulating in the unit. Hence, a more efficient fan unit can be produced as a lower power can be used to drive the fan to achieve the same circulating air velocity.

The fan unit of the present invention is primarily intended for use in a clean room. Therefore, the unit preferably comprises a filter. Generally, this filter will be located below the base plate of the unit.

The guides and/or the baffles of the present invention will preferably be made from a solid material, more preferably a metal. The guides and/or baffles may also be perforated.

The fan unit of the present invention preferably does not comprise conventional sound insulation material in contact with the airflow flowing through the unit. Sound insulation material may be included in the fan unit, but is preferably separated from the airflow by a solid structure, such as a baffle or wall means.

The present invention will now be described with reference to the following non-limiting embodiments which:

Figure 1:
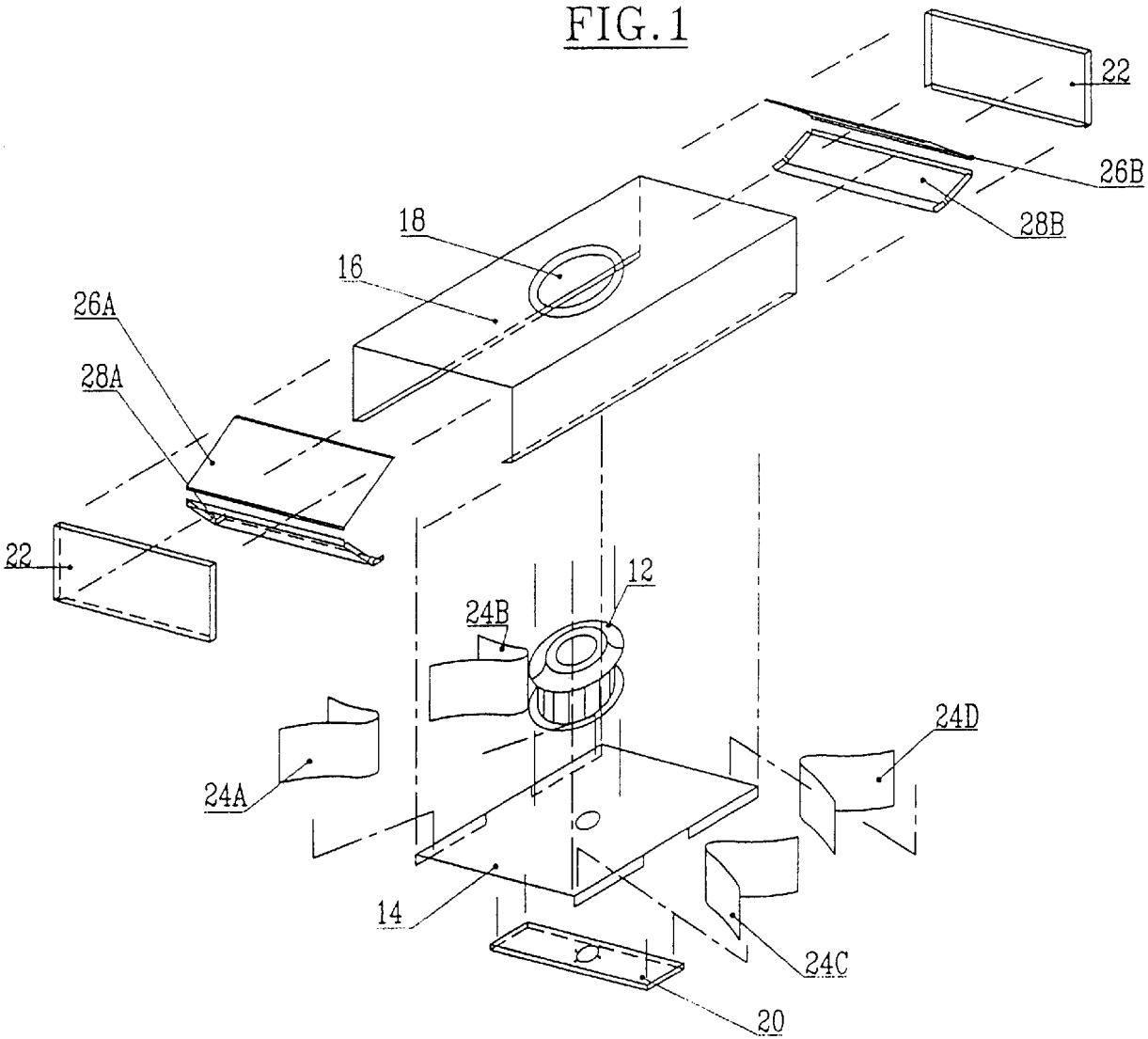
FIG. 1 is an exploded, right side, perspective elevation view of an embodiment of the present invention.

FIG. 1 shows an exploded view of the fan filter unit. For clarity, the filter is not shown. A rotatable fan blower 12 is located on a base plate 14. A mounting plate 20 for the fan blower 12 is located on an opposing side of the base plate 14 to the fan blower 12.

The fan blower 12 is located within a housing which is formed from the base plate 14, an upper housing 16 and end sections 22. The upper housing 16 has an air inlet 18 located in its centre, such that in use, the air inlet is located above fan blower 12. Fan blower 12 is a conventional type blower. It is configured to be rotated by a motor (not shown) which will be located on opposing side of base plate 14 to the fan blower 12. As the fan blower rotates, it air is drawn through inlet 18 and expelled air in direction tangential to the rotation direction of the fan blower 12.

The fan blower is also provided with first and second guide means 24A and 24B on one side and third and fourth guide means 24C and 24D on the other side. The shape of the guide means will be described further below in relation to FIG. 3.

Upper baffles 26A and 28B and lower baffles are provided at either end of the unit, such that the baffles are disposed between fan blower 12, guide means 24A, and 24B and 24C and 24D and the end section 22.

Figure 2:
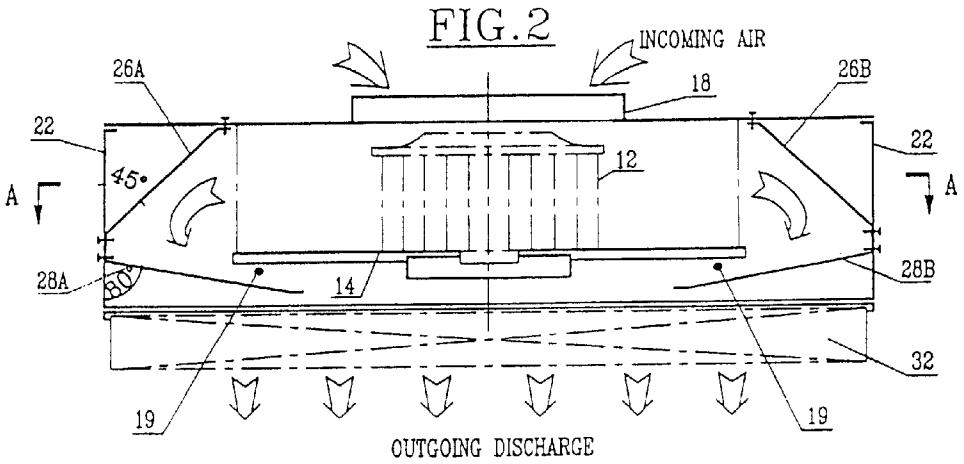
FIG. 2 is a front, cross sectional elevation view of the embodiment of FIG. 1.

FIG. 2 shows the direction of air flow within the fan filter of FIG. 1. As previously described, air is drawn in through inlet 18 by the rotation of fan blower 12. Fan blower 12 is located on base plate 14. The rotation of the fan blower forces air away from the fan blower and into the baffles 26A and 26B and 28A and 28B. The direction of the baffles turns the air from travelling away from the blower which is located on the base plate to travelling out of the outlet 19 which is located beneath the base plate 14. The air then travels through filter 32 which is located underneath opening 19.

Figure 3:
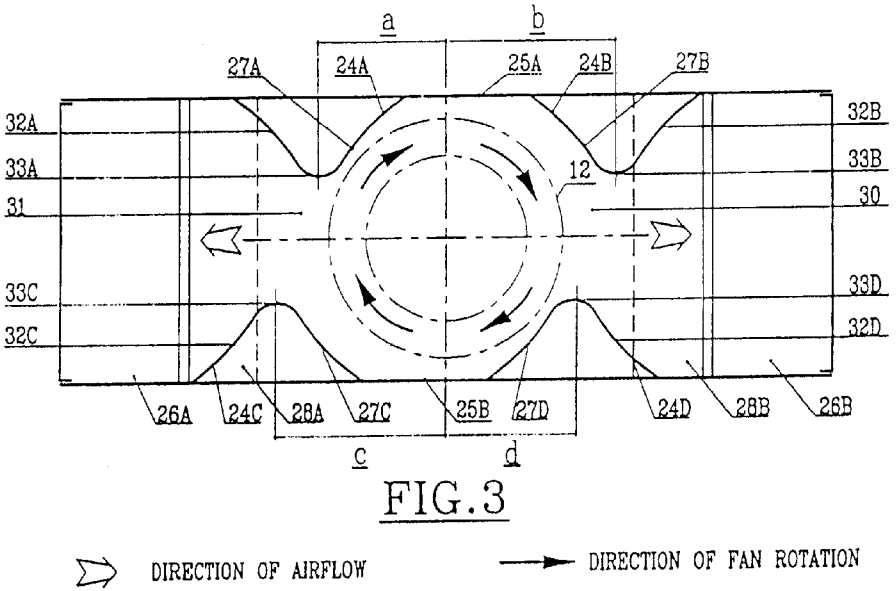
FIG. 3 is a top, plan elevation view of section A—A in FIG. 2.

FIG. 3 shows a plan view of the constructed fan filter unit of FIGS. 1 and 2. The fan blower 12 is located in a space between the guide means 24A, 24B, 24C and 24D. On one side of the fan filter unit, there is a first guide surface 27A and a second guide surface 27B. Along with a portion of the wall 25A, the guide surfaces define a radially outer boundary of an airflow path of which leads, through constriction 30, to the upper baffle 26B. A third guide surface 27C and a fourth guide surface 27D are provided on the other side of the fan blower, and together with a part of the wall 25B between them, define the radially outer boundary of a second flow path which leads through constriction 31 to the upper baffle 26A. It can be seen that each guide means comprises an additional guide surface 32A, 32B, 32C and 32D respectively. It can be seen that the additional guide surfaces 32A and 32C define between them a diverging flow path leading from constriction 31. Additional guide surface 32B and 32D define between them a diverging flow path leading from constriction 30.

It can be seen that of the guide means 24A, 24B, 24C and 24D are identical in shape to the other guide means. Each comprises a smoothly curving guide surface and a smoothly curving additional guide surface with a smoothly curving transitional zone 33 between them. This smoothly curving transitional zone is provided to reduce turbulence and improve airflow velocity It is also apparent from FIG. 3 that the distance a from the centre of the smoothly curving portion 33A to the centre line of the fan blower is less than the distance b of the transitional portion 33B from the centre line of the fan blower.

Similarly, on the other side, the distance d of the transitional portion 33D from the centre line of the fan blower is less than the distance c of the centre of the transitional portion 33C from the centre line of the fan blower In this way, with identically shaped guide means, a diverging flow path can be provided around the periphery of the fan blower.

The guides 24A, 24B, 24C and 24D are contoured to receive the discharged air from the fan blower 12 (shown in dotted circle) and guide the flow of air with minimum amount of turbulence towards the baffles 26 and 28. As this is a top view, the lower baffle 28 is not clearly shown.

The upper baffles 26 are disposed at angles of about 45° to the plane of air which is emitted from blower 12, to diffuse air from the guides 24. The lower baffles 28 are disposed at an angle of about 10° to the airflow plane to redirect the flow of air below the base plate 14.

Figure 4:
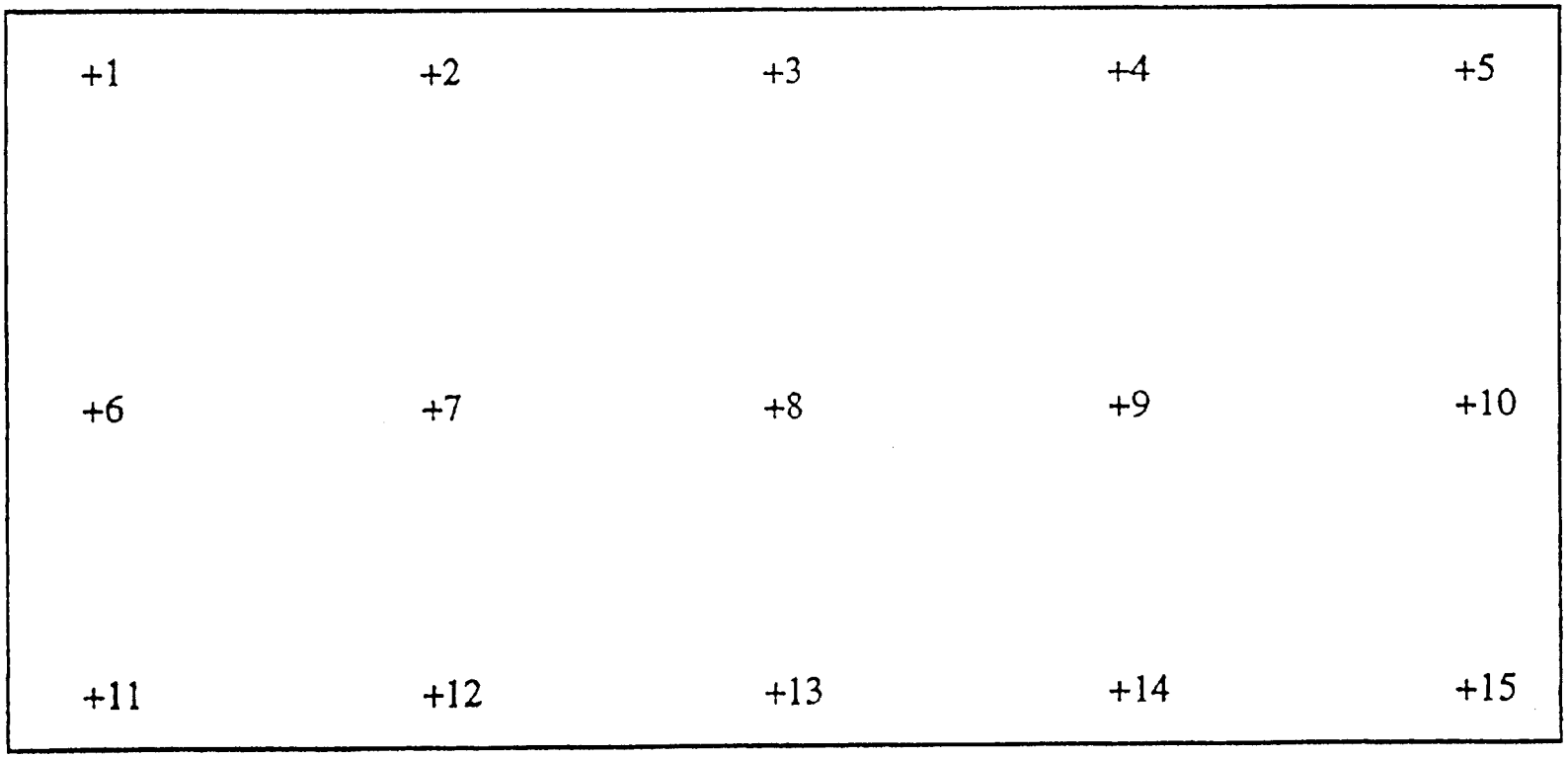
FIG. 4 shows the locations in the fan filter unit where the airflow velocities were measured for FIG. 5.
Figure 5:
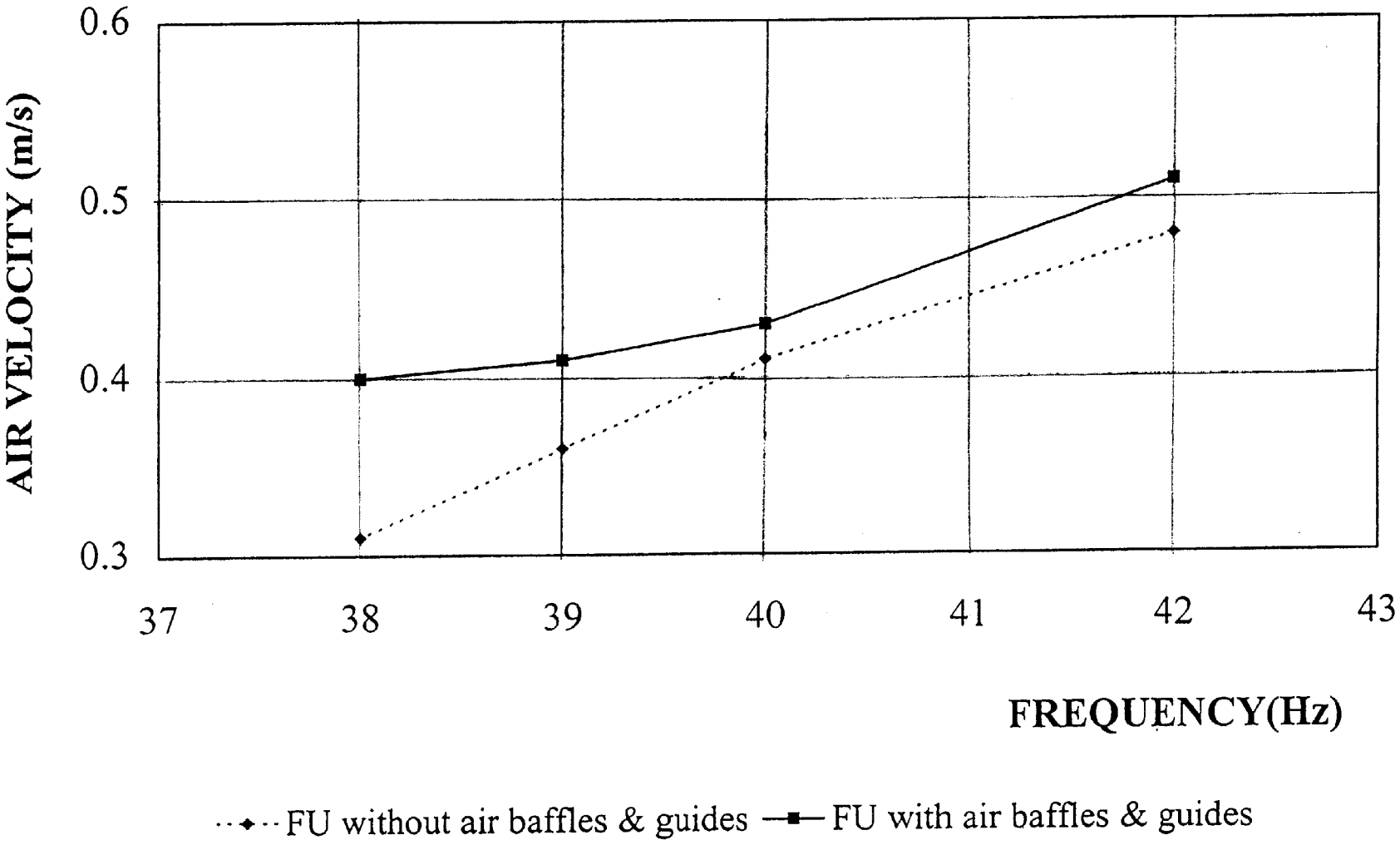
FIG. 5 is a chart showing the average velocity of airflow and rotation frequency of the fan blower of a fan filter unit with and without the present invention.
Figure 6:
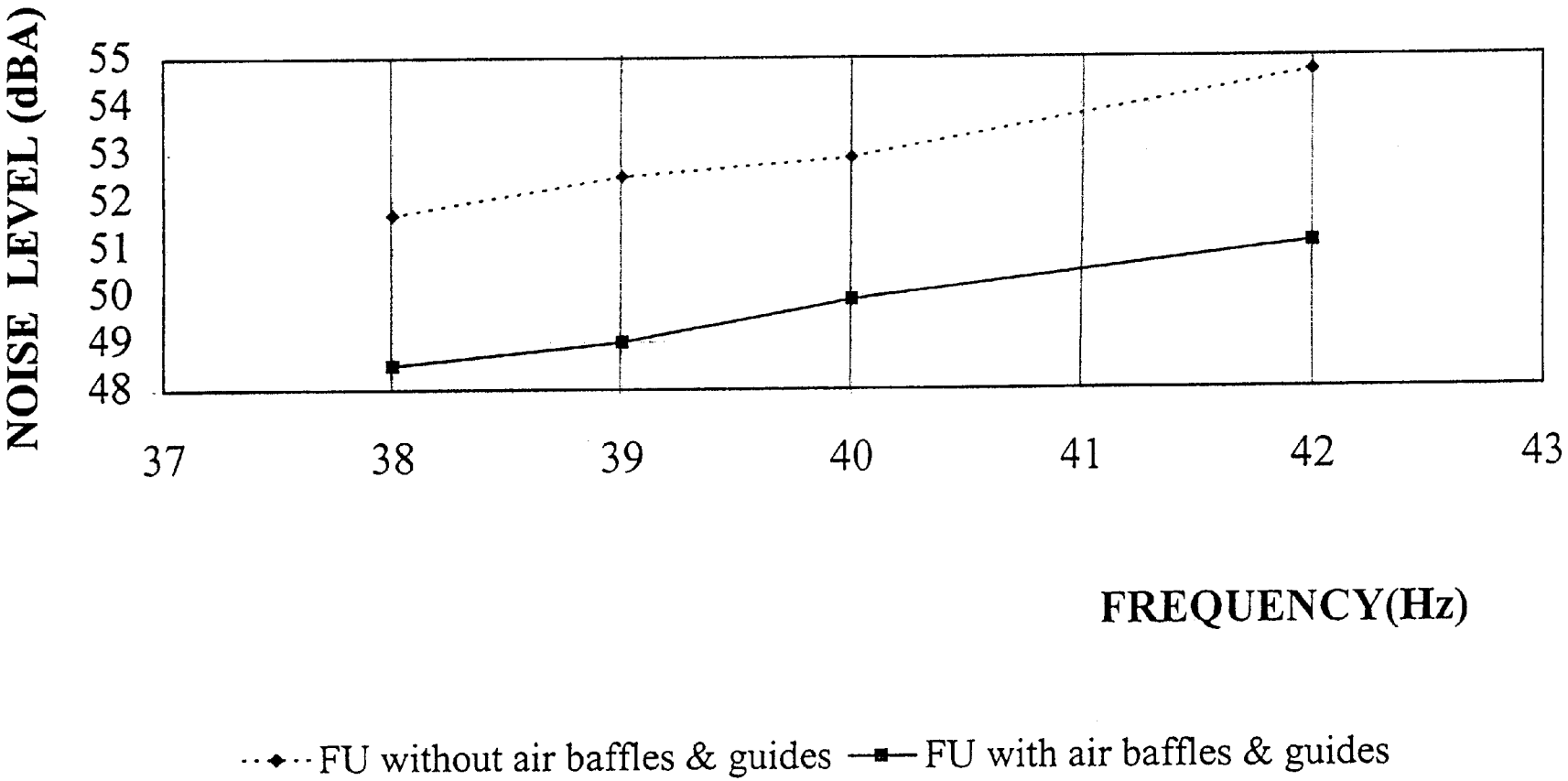
FIG. 6 is a chart showing the average noise level and rotation frequency of the fan blower or a fan filter unit with and without the present invention.

FIGS. 4,5 and 6 show results from the fan unit. FIG. 5 shows a plot of the air velocity averaged over measurements taken at 15 different points in the fan unit. The 15 locations within the fan unit are shown in FIG. 4. Similarly, FIG. 6 shows a plot of the noise level averaged over measurements taken at the same fifteen different points in the fan unit against rotation frequency of the fan blower.

The noise level is measured at a distance one meter away from the fan, in decibels.

It can be seen that far superior results are provided when the air guide and baffle are present. Thus, the present invention allows a higher air velocity which provides enhanced air circling action with the same amount of driving power to the fan. Hence, the present invention provides considerable energy advantages to that of the prior art.

What is claimed is:

1. A fan unit comprising:

a fan blower configured to emit air in a plurality of directions in an air flow plane;

first and second guide surfaces disposed on a first side of the fan blower in the airflow plane, the first and second guide surfaces defining together, at least partially, the radially outer boundary of a first airflow path leading to a first airflow channel;

third and fourth guide surfaces disposed on a second, opposite, side of the fan blower in the air flow plane, the third and fourth guide surfaces defining together, at least partially, the radially outer boundary of a second airflow path leading to a second airflow channel;

first, second, third and fourth guide means each comprising the first, second, third and fourth guide surfaces, respectively;

wherein the fan unit further comprises a first wall means on the first side of the fan blower, the first guide surface touching the first wall means at a first point and the second guide surface touching the first wall means at a second point displaced from the first point, and the fan unit comprises a second wall means on a second side of the fan blower, the third guide surface touching the second wall means at a third point and the fourth guide surface touching the second wall means at a fourth point displaced from the third point.

2. A fan unit according to claim 1, wherein the portion of the first wall means between the first and second points effectively defines a further guide surface.

3. A fan unit according to claim 1, wherein the portion of the second wall means between the third and fourth points effectively defines a second further guide surface.

4. A fan unit according to claim 1, wherein all of the guide means are identical to one another.

5. A fan unit according to claim 2, wherein all of the guide means are identical to one another.

6. A fan unit according to claim 3, wherein all the guide means are identical to one another.

7. A fan unit according to claim 1, wherein the fist and second airflow channels each lead to a first baffle arranged at an angle to the direction of the airflow to deflect the airflow.

8. A fan unit according to claim 7, wherein the first and second airflow channels further comprise a second baffle arranged at an angle to the direction of the airflow coming from the first baffle to further deflect the flow.

9. A fan unit according to claim 8, wherein at least one of the first and second baffles comprise perforated material.

10. A fan unit according to claim 8, wherein the first and second airflow channels each comprise a final baffle for deflecting the airflow.

11. A fan unit according to claim 2, wherein the first and second airflow channels each lead to a first baffle arranged at an angle to the direction of the airflow to deflect the airflow.

12. A fan unit according to claim 3, wherein the first and second airflow channels each lead to a first baffle arranged at an angle to the direction of the airflow to deflect the airflow.

13. A fan unit according to claim 1, wherein each guide means is substantially symmetrical about a mirror plane so that the guide means comprises a first guide surface and a substantially identical additional guide surface.

14. A fan unit according to claim 2, wherein each guide means is substantially symmetrical about a mirror plane so that the guide means comprises a first guide surface and a substantially identical additional guide surface.

15. A fan unit according to claim 3, wherein each guide means is substantially symmetrical about a mirror plane so that the guide means comprises a first guide surface and a substantially identical additional guide surface.

16. A fan unit according to claim 4, where each guide means is substantially symmetrical about a mirror plane so that the guide means comprises a first guide surface and a substantially identical additional guide surface.

17. A fan unit according to claim 7, wherein each guide means is substantially symmetrical about a mirror plane so that the guide means comprises a first guide surface and a substantially identical additional guide surface.

18. A fan unit according to claim 10, wherein each guide means is substantially symmetrical about a mirror plane so that the guide means comprises a first guide surface and a substantially identical additional guide surface.

* * * * *

UNITED STATES PATENT AND TRADEMARK OFFICE

CERTIFICATE OF CORRECTION

PATENT NO. : 6,592,451 B2
APPLICATION NO. : 10/191928
DATED : July 15, 2003
INVENTOR(S) : Zong Tang Lee It is certified that error appears in the above-identified patent and that said Letters Patent is hereby corrected as shown below:

On the title page item (75), INVENTOR, replace "Lee Zong Tang" with --Zong Tang Lee--

Signed and Sealed this

Sixth Day of February, 2007

JON W. DUDAS
*Director of the United States Patent and Trademark Office*